United States Patent [19]

Finley

[11] Patent Number: 4,808,081

[45] Date of Patent: Feb. 28, 1989

[54] HOSE AIR PURGING, PUMP ANTI-DEPRIMING METHOD AND APPARATUS

[75] Inventor: Richard O. Finley, Huntington Beach, Calif.

[73] Assignee: Plastiflex Company International, Fountain Valley, Calif.

[21] Appl. No.: 22,480

[22] Filed: Mar. 5, 1987

Related U.S. Application Data

[63] Continuation of Ser. No. 636,332, Jul. 31, 1984, abandoned.

[51] Int. Cl.[4] ..... F04B 39/00; F04H 3/16

[52] U.S. Cl. ..... 417/57; 417/199.1; 4/490; 4/507; 4/509

[58] Field of Search ..... 417/53, 199 A; 4/490, 4/507, 509; 137/147

[56] References Cited

U.S. PATENT DOCUMENTS

| | | | |
|---|---|---|---|
| 1,442,314 | 1/1923 | Weir | 137/147 X |
| 2,701,235 | 2/1955 | King | 210/11 |
| 3,054,418 | 9/1962 | Fromer | 137/147 X |
| 3,450,052 | 6/1969 | Turner et al. | 417/203 |
| 4,347,979 | 9/1982 | Mathews | 4/490 X |
| 4,631,973 | 12/1986 | Eley | 418/206 X |

FOREIGN PATENT DOCUMENTS

| | | | |
|---|---|---|---|
| 411026 | 3/1925 | Fed. Rep. of Germany . | |
| 444350 | 5/1927 | Fed. Rep. of Germany . | |
| 3120860 | 12/1982 | Fed. Rep. of Germany . | |
| 1238144 | 6/1960 | France | 137/147 |
| 1417008 | 9/1965 | France . | |
| 56-54976 | 5/1981 | Japan | 417/199 A |
| 407640 | 3/1934 | United Kingdom . | |
| 758519 | 10/1956 | United Kingdom | 417/201 |

*Primary Examiner*—William L. Freeh

*Attorney, Agent, or Firm*—Lewis B. Sternfels

[57] ABSTRACT

Apparatus (42, 72) for filling a hose (36) with water (12) and simultaneously for expelling air from the hose while connected to the vacuum side of a pump (20) in preparation for cleaning debris from a swimming pool (10) without loss of the prime in the pump comprises a housing (44, 74) submergeable in the water and having a pair of chambers (46, 48 & 76, 78) respectively having inlets (58, 80) and outlets (64, 86), with the inlets being open to the water and the outlets being coupled respectively to the pump and to the hose. Impellers (54, 100 & 56, 102) respectively in their chambers are coupled together by a shaft (52, 98) in which a first of the impellers (54, 100) is driven by a second of the impellers (56, 102) when water is drawn by the pump past the second of the impellers. In one embodiment, elbow conduit (110) can be slid from a first position where water purges air from the hose to a second position where the hose is used to clean debris from the swimming pool. In another embodiment a hose end is first coupled to the pump's pressure side (24) to expel air from the hose and thereafter, without removing the hose end from the water, the hose end is coupled to the pump's vacuum side (22) to vacuum the pool.

21 Claims, 4 Drawing Sheets

HOSE AIR PURGING, PUMP ANTI-DEPRIMING METHOD AND APPARATUS

This is a continuation of Ser. No. 06/636,332 filed July 31, 1984, now abandoned.

FIELD OF THE INVENTION

The present invention relates to a method and apparatus for purging air from a hose while preventing the loss of the prime in a pump to which the hose is attached.

DESCRIPTION OF THE PRIOR ART AND BACKGROUND CONSIDERATIONS

Pumps, when hoses are connected to the pump's vacuum side, create a negative pressure in the hoses for conveying liquids therethrough. Such pumps are subject to the serious problem of loss of prime when air or other gas is trapped within the hose and is drawn into the pump. While this problem exists in many areas of liquid transport, one major area of concern involves the cleaning of debris from swimming pools by suction hoses.

The most common current method for purging the hose of air is to place one end of the hose into the pool and to slip the hose slowly into the pool so that the water can move into and through the hose. If any air should inadvertently be left within the hose, when the hose is attached to the pool pump, and if the air reaches the pump, the pump will be deprimed. Therefore, extreme care and time must be taken to prevent entrapment of air within the hose.

Another method is where the operator's mouth is placed on an end of the hose so that water can be sucked into and through the hose. When the operator moves the hose from his mouth to the skimmer inlet, he must place his hand over the end of the hose to prevent entry of air into it.

In either case, filling of the hose with liquid to purge air therefrom is a lengthy and tiresome process. For a professional pool cleaner, this loss of time translates into a loss of income.

Because most swimming pools have a pool skimmer which is used to clean debris floating on the surface of the water by the pool pump, such a vacuum hose is conventionally coupled to the pump through the skimmer.

SUMMARY OF THE INVENTION

The present invention overcomes these and other problems by using the kinetic energy created by water flow to or from the existing pump to fill the hose with liquid and thereby to expel all the air therefrom.

Specific methods of accomplishing this are disclosed in the detailed description of the invention. Briefly, for pools under construction, a return line from the pressure side of the pump is attached to an orifice at the bottom of the skimmer. The orifice is terminated by a unidirectional valve which does not allow water to flow into the skimmer, but would permit the hose to be inserted into the valve and into communication with the pump's pressure side. This allows the hose to be filled with water, thereby expelling all air from the hose. The hose is then moved from the pressure orifice to the vacuum orifice adjacent thereto in the skimmer without removing the end of the hose from the water.

For pools which are already constructed, adding a return line to the skimmer would be very difficult and expensive. Therefore, the invention contemplates a specially designed construction to provide the same action by using the kinetic energy created by the water flow on the vacuum side of the pump. This construction has a driving impeller with a turbine vane coupled to a driving impeller. The water flow is used to turn the turbine vane to drive the driven impeller which acts as a pump to push water through the hose and thereby to expel all of the air therefrom. This construction is adapted for use in the existing skimmer inlet and is embodied in one of several designs, such as a part of the skimmer, a permanent attachment to the hose, or as a detachable attachment which is coupled to the hose for expulsion of air and removed from the hose after it has been filled with water.

The method and apparatus of the present invention provides many advantages. Primarily, it is a fast and efficient method of filling a hose completely with a liquid by use of the pump, without causing loss of the prime in the pump. As a result, the homeowner or professional pool cleaner is relieved of much tedious and lengthy work, along with associated annoyance. Since time is conserved, the operator's time may be utilized for productive work or other activities. In the case of a professional pool cleaner, this savings of time permits a larger number of pools to be serviced, which translates into increased income or decreased loss of profit.

Other aims and advantages, as well as a more complete understanding of the present invention, will appear from the following explanation of exemplary embodiments and the accompanying drawings thereof.

DESCRIPTION OF THE PREFERRED EMBODIMENTS

Figure 1:
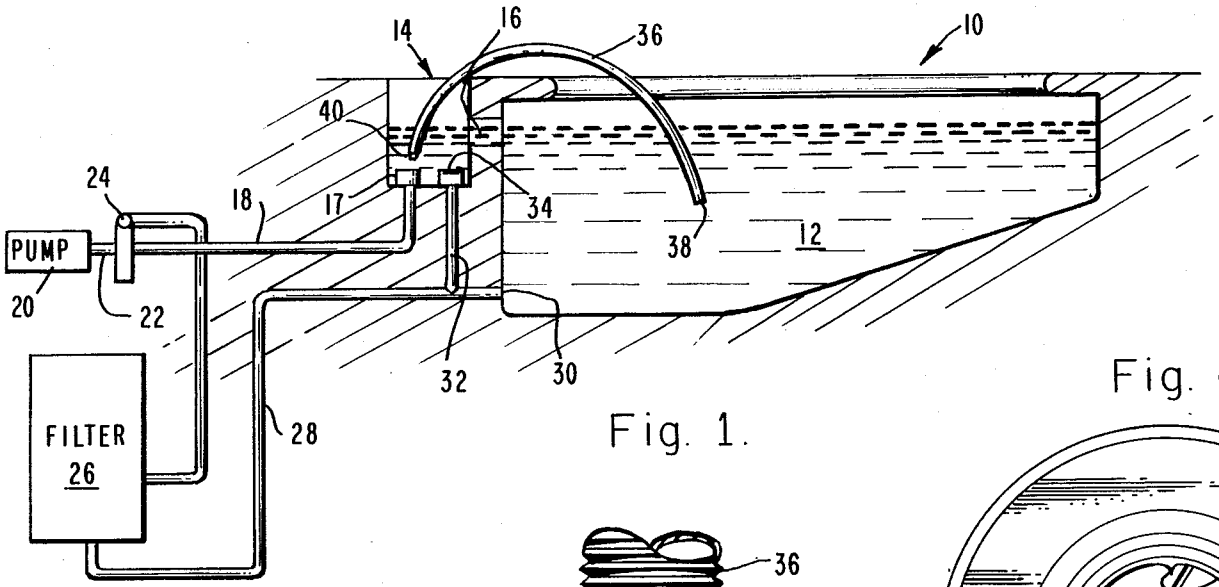
FIG. 1 illustrates a swimming pool with associated skimmer and pump, and an added circuit and unidirectional valve to provide a source of positive liquid pressure from the pressure side of the pump, which valve is adjacent the negative pressure inlet to the vacuum side of the pump, with the valve shown closed in FIG. 1 and opened by a hose cuff in FIG. 1*a;*

A conventional swimming pool arrangement for a swimming pool 10 filled with water 12 is shown in FIG. 1. The water in the pool communicates with an adjacent skimmer 14 of conventional construction through a channel 16, in which a floating weir is placed. The weir permits only surface water from the pool to be skimmed so that any floating debris thereon may be drawn into skimmer 14. Placed within the skimmer is a conventional strainer basket (not shown) and leading from the opening 17 in the skimmer is an intake conduit 18 which is coupled to a pump 20 at its vacuum or negative pressure side 22. Pump 20 discharges the water out of its pressure side 24, that is, a side which produces a positive pressure, through a filter 26, and back to the pool by a return conduit 28 at its outlet 30. At this point, the above-described arrangement is conventional.

The present invention adds a further conduit 32 which leads from return conduit 28 to skimmer 14. At its entry to the skimmer, conduit 32 is terminated by a unidirectional valve 34 of conventional construction.

Valve 34 is designed to open towards return 28 and is prevented from opening into skimmer 14. It is normally biased into a closed position as shown in FIG. 1 by both a conventional spring and the positive water pressure within conduit 32.

For cleansing of debris from pool 10, a hose 36 is utilized. One end 38 of the hose or of a hose attachment is used to sweep the bottom of the pool while the other hose end 40 is disposed to be connected to intake 18 so that pump 20 will suck debris through end 38 and the hose. Usually a strainer is placed within the skimmer to prevent the debris from clogging the pump. Because the pump will lose its prime should any air in the hose be caught in the pump, it is necessary first to remove or purge any air from the hose.

Figure 1A:
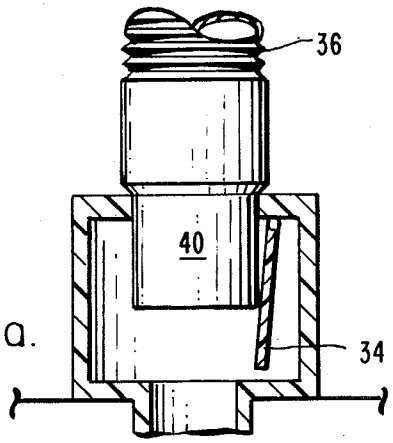

One purging method, which is accomplished in the present invention, is first to connect cuff 40 with conduit 32 through unidirectional flow valve 34 as illustrated in FIG. 1*a*. With the pump operating, a positive liquid pressure flows water through conduit 32 and thence through hose 36, to force or expel any air in the hose out through hose end 38. At such time as the air is purged or expelled from the hose, cuff 40 is removed from conduit 32 which is closed upon closure of valve 34 by its spring and the pressure within conduit 32. Then, while keeping cuff 40 beneath the surface of the water, the cuff is inserted into opening 17 of conduit 18 which terminates at skimmer 14. Pump 20 thereupon draws water and any debris carried thereby from the the pool through the hose.

Figure 4:
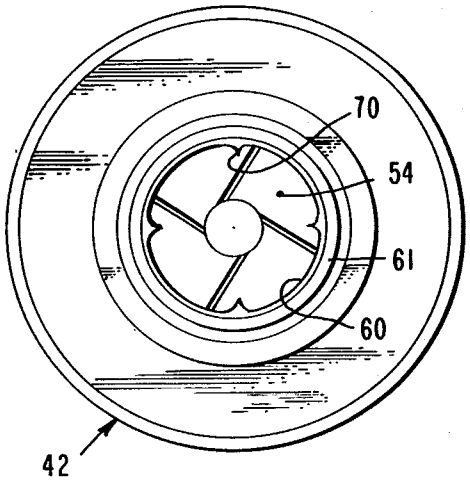
FIGS. 2–4 are views of a first embodiment of the present invention.
Figure 2:
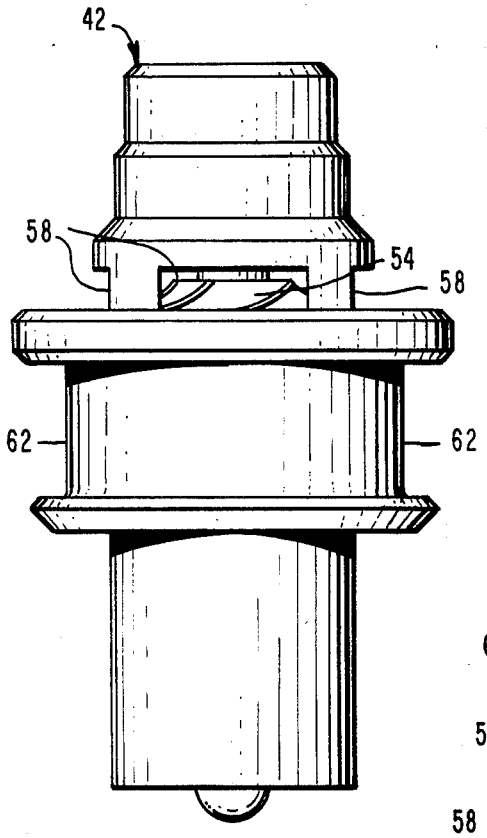
Figure 3:
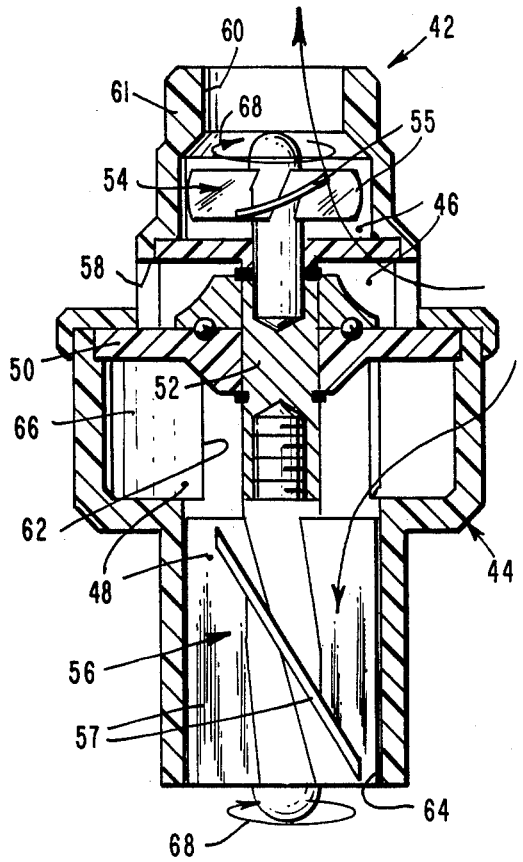

FIGS. 2–4 illustrate an apparatus 42 which may be used in lieu of conduit 32 for creating a positive pressure of water through hose 36. Apparatus 42 is disposed to be fully submerged in water. It comprises a housing 44 which is divided into a pair of chambers 46 and 48 by a plate 50, which acts also as a bearing mount for a shaft 52. Shaft 52 terminates in respective chambers 46 and 48.

An impeller 54 having vanes 55 is secured to one end of shaft 52 in first chamber 46, while a second impeller 56 having turbine vanes 57 is secured to the shaft within second chamber 48. First chamber 46 has one or more inlets 58 and an outlet 60. Inlet 58 is disposed to reside within water 12 within skimmer 14 while outlet 60 has a connection 61 to cuff 40 of hose 36.

Second chamber 48 is also provided with one or more inlets 62 and an outlet 64 so that water within skimmer 14 may flow into chamber 48 through inlets 62 and through outlet 64. A water flow channel 66 of a general spiral form enables water to move into chamber 48 in a circulatory movement in order to strike turbine vanes 57 of impeller 56 and thus to maximize the rotational forces exerted thereagainst.

Because of the flow of water through chamber 48, impeller 56 rotates and the driving force of impeller 56 is transmitted through shaft 54 to drive impeller 54. Rotation of impeller 54 pumps water through inlets 58 and through outlet 60 and thence through hose 36 to purge the hose of air. As shown, rotation of the impellers is in the direction of arrows 68. Because of the slant of vanes 57, the flow of water is through opposite outlets 60 and 64.

As best shown in FIG. 4, if it is desired to have the flow through outlet 60 move in a less swirling direction, projections 70 may be placed within outlet 60.

In operation, connection 61 of apparatus 42 is coupled to cuff 40 of hose 36, and outlet 64 is inserted within termination or opening 17 of pump intake 18. Upon actuation of pump 20, water from skimmer 14 flows through inlets 62, through chamber 48, and into contact with turbine vanes 57 of impeller 56 to rotate the impeller in the direction of arrow 68. Such rotation causes shaft 52 and impeller 54 also to rotate. As impeller 54 rotates, it acts as a pump, that is, its vanes 55 cause fluid to flow through inlets 58, chamber 46 and out of outlet 60 and to force the fluid into hose 38, thus forcing air therefrom. After all air has been purged or expelled from the hose, apparatus 42 is uncoupled from cuff 40 of hose 36 and from opening 17 of skimmer 14. The cuff is then inserted within opening 17 and thereby directly connected to pump intake 18. During and after the uncoupling and its insertion within opening 17, cuff 40 is kept beneath the surface of the water to prevent air from reentering the hose, as described with respect to the embodiment of FIGS. 1 and 1*a*.

Figure 5:
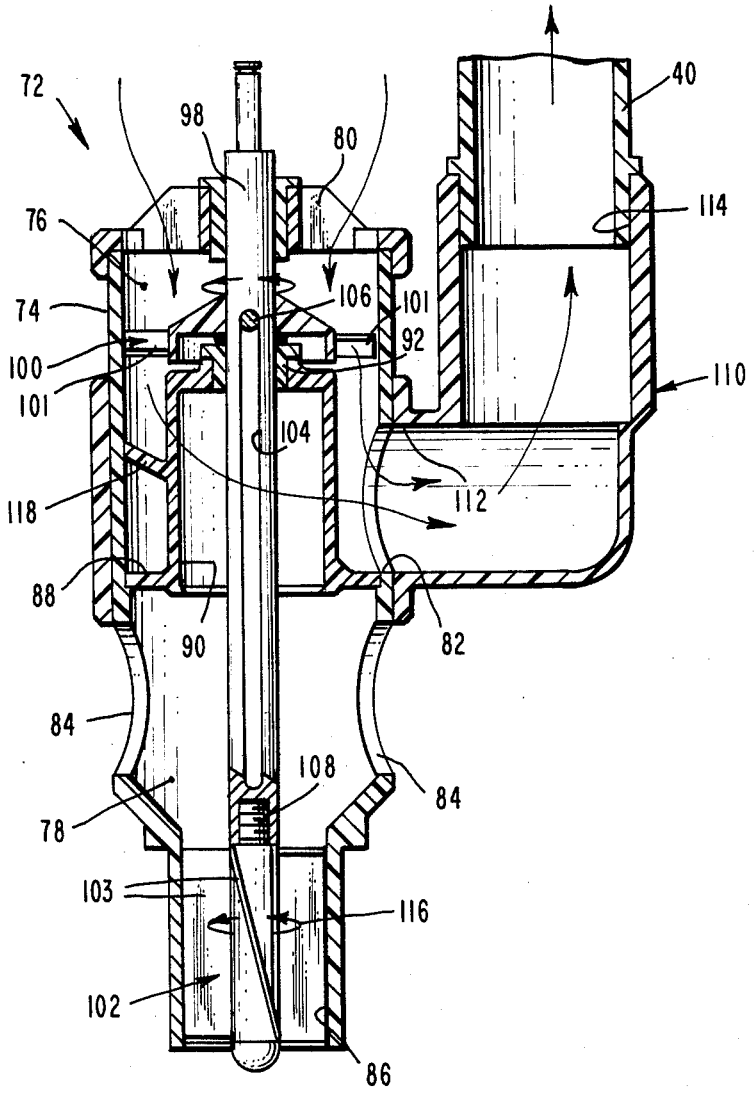
FIGS. 5 and 6 are views of a second embodiment respectively showing its air-purging position and its hose suction position after purging is accomplished.
Figure 6:
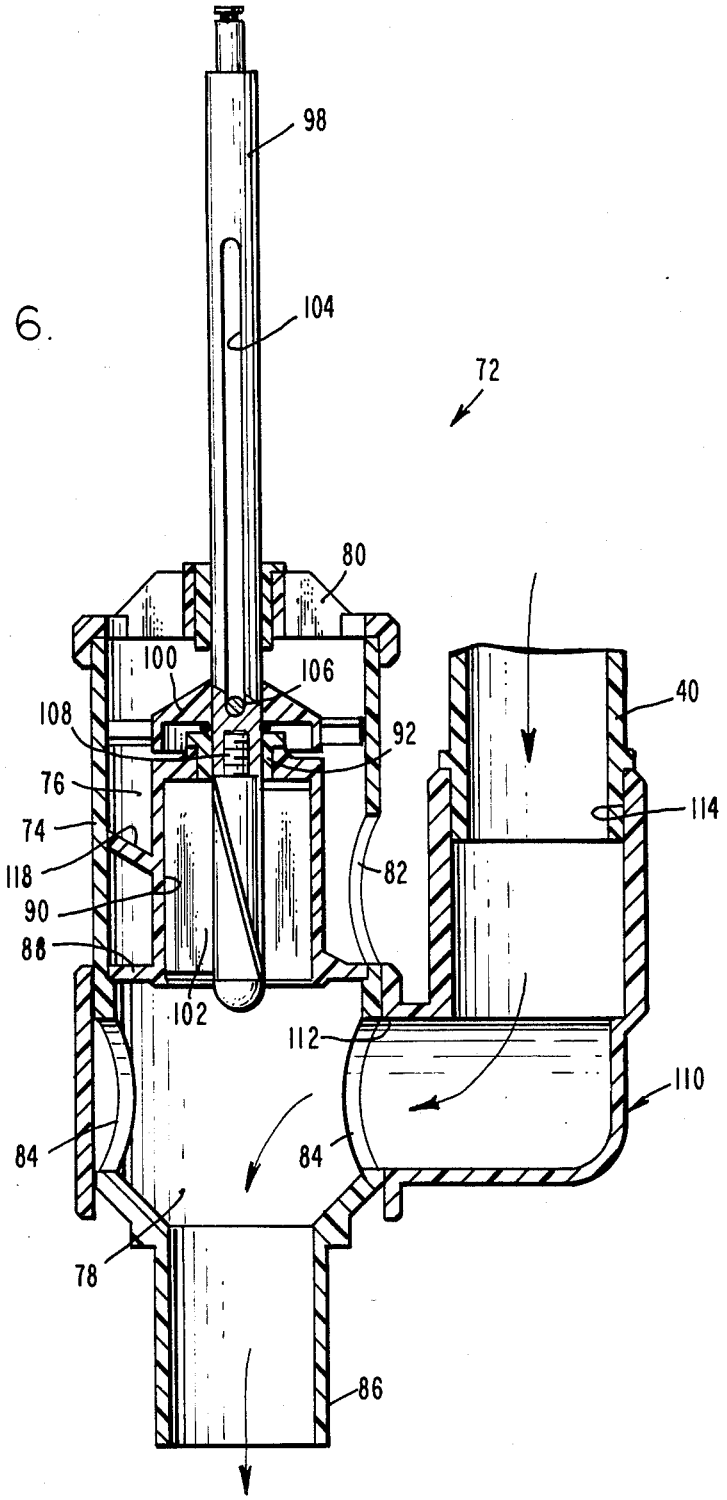

Referring now to FIGS. 5 and 6, a further embodiment is depicted as an apparatus 72 which also is to be fully submerged in the water. It includes a cylindrical housing 74 which is divided into first and second chambers 76 and 78. Liquid can enter first chamber 76 through an inlet 80 and can exit therefrom through an outlet 82. In a like manner, chamber 78 has liquid inlets 84 and an outlet 86.

The chambers are separated by a plate 88 which is provided with a recess 90 in communication with chamber 78 and which extends away from chamber 78 towards chamber 76. At the upper end of separator plate 88 and recess 90 is a bearing 92 which, along with bearing 94 in a spoked bearing cap 96 at inlet 80 supports a rotatable shaft 98. The bearing cap is spoked to provide openings for inlet 80. An impeller 100 having vanes 101 is secured to shaft 98 within chamber 76 while a second impeller 102 having turbine vanes 103 is secured to the shaft within chamber 78. Impeller 100 is connected to shaft 98 so that it will rotate therewith. In addition, their connection also permits reciprocation with a slot 104 in shaft 98 through which a pin 106 extends. Pin 106 is affixed to impeller 100 so that shaft 98 may be linearly moved with respect to impeller 100. Impeller 102, on the other hand, is securely affixed to the shaft by a threaded connection at 108; thus, impeller 102 rotates with shaft 98 while the connection between impeller 100 and shaft 98 is rotatable and reciprocal.

Placed about the periphery of housing 74 is a slidable attachment 110 formed as an elbow conduit having a pair of openings 112 and 114. As shown in FIGS. 5 and 6, attachment 110 is slidable between first and second positions where its first position aligns its opening 112 with outlet 82 of chamber 76. In its second position, shown in FIG. 6, attachment opening 112 is aligned with one of inlets 84 of chamber 78 while blocking off any others of inlets 84.

Cuff 40 of hose 38 is disposed to be coupled with opening 114 of attachment 110.

In operation, apparatus 72 is submerged in water 12 and is first inserted into termination or opening 17 of intake 18 at skimmer 14 by fitting outlet 86 within the intake termination. At this point, slidable attachment 110 is positioned as shown in FIG. 5 so that its opening 112 is aligned with outlet 82 of chamber 76. In addition, shaft 98 is slid fully within housing 74 so that impeller 102 is seated within outlet 86. Upon actuation of pump 20, water from skimmer 14 flows through inlets 84, through chamber 78, and into contact with turbine vanes 103 of impeller 102 to rotate the impeller in the direction of arrow 116. Such rotation causes shaft 98 and impeller 100 also to rotate. As impeller 100 rotates, it acts as a pump, that is, its vanes 101 cause fluid to flow through inlet 80, chamber 76 and out of outlet 82 for passage through slidable attachment 110 into cuff 40 and hose 38. A diverter 118 extending about the outer wall of recess 90 of separator plate 88 helps to smooth the flow of the water through chamber 76.

After all air has been purged or expelled from the hose, slidable attachment 110 is slid downwardly so that, as shown in FIG. 6, its opening 112 is aligned with inlet 84 of chamber 78. Also, impeller 102 is moved out of outlet 86 by upward sliding of rod 98 so that impeller 102 resides within recess 90. Accordingly, water will flow from the hose into opening 114 of attachment 110 and thence through chamber 78 in outlet 86 into the pump, with a minimum of impediment to fluid flow.

Although the invention has been described with reference to particular embodiments thereof, it should be realized that various changes and modifications may be made therein without departing the spirit and scope of the invention.

What is claimed is:

1. A method for purging a gas from a conduit through which a liquid is to be conveyed to and from a source of the liquid by a unidirectional source of negative and positive liquid pressures, the pressure source having an inlet for the negative pressure and an outlet for the positive pressure, without causing the pressure source to lose its prime, comprising the sequential steps of:

coupling both the conduit and the inlet to the liquid source for creating a positive pressure of the liquid in the conduit by the pressure source to flow the liquid in a forward direction away from the pressure source and thus to expel the gas from the conduit;

thereafter coupling the conduit directly to the inlet for creating a negative pressure of the liquid in the conduit by the pressure source to reverse the direction of the liquid flow back towards the pressure source; and maintaining both the negative and positive pressures in the pressure source during both said coupling steps.

2. A method according to claim 1 wherein the conduit has one end couplable to the source and in which said coupling step for creating the positive liquid pressure in the conduit comprises the step of coupling the conduit to the pressure source outlet to enable the pressure source to force the liquid into the one conduit end in the forward direction.

3. A method according to claim 1 in which said coupling step for creating the positive liquid pressure in the conduit comprises the steps of impelling portions of the liquid into the pressure source and into the conduit, wherein said step of impelling the liquid into the pressure source enables said step of impelling the liquid into the conduit.

4. A method according to claim 1 in which said coupling step for creating the positive liquid pressure in the conduit comprises the steps of coupling a first impeller to the pressure source to draw some of the liquid into the pressure source, coupling a second impeller to the conduit, and coupling the first and second impellers together so that the first impeller causes the second impeller to pump some of the liquid through the conduit in the forward direction.

5. A method according to claim 4 in which said coupling step for creating the negative liquid pressure in the conduit comprises the steps of decoupling the first and second impellers respectively from the pressure source and the conduit, and coupling the conduit to the pressure source.

6. A system having a pump which is unidirectionally operated to provide negative and positive liquid pressures respectively in its inlet and outlet and which is coupled to a conduit for flow of liquid therethrough and for expelling any gas therefrom without depriming the pump, comprising:

means for effecting a first coupling of the conduit and the pump inlet for enabling the pump to flow the liquid away from the pump in a forward direction through the conduit and thus to purge the gas therefrom while preventing the gas from entering the pump; and means for effecting a second coupling of the conduit and the pump outlet for enabling the pump to flow the liquid towards the pump in a direction reversed from the forward direction.

7. A system according to claim 6 wherein the inlet and the outlet are coupled to a swimming pool, and wherein the conduit comprises a vacuum hose for cleaning debris from the pool, in which said first coupling effecting means comprises a coupling for establishing a connection between the outlet and the hose, and said second coupling effecting means comprises said coupling to the hose being reestablished from the outlet to the inlet.

8. A system according to claim 7 wherein the pool includes a skimmer and the inlet and the outlet have terminations in the skimmer, further including a normally closed undirectional valve in the outlet termination which is operable by said coupling when said connection is established.

9. A system according to claim 6 in which said first coupling effecting means includes driving and driven impellers respectively coupled to the pump inlet and the conduit, and means for connecting said impellers together to cause said pump inlet-coupled driving impeller to drive said conduit-coupled driven impeller.

10. A system according to claim 11 wherein said first coupling effecting means further includes a housing having first and second chambers in which said driven and driving impellers are respectively journalled, said first chamber having means disposed to convey the liquid through said first chamber to the conduit and past said driven impeller upon rotation thereof, and said second chamber having means disposed to convey the liquid through said second chamber to the pump inlet and past said driving impeller for rotation thereof.

11. A system according to claim 10 in which said first and second chamber means respectively have inlets and outlets for respective conveyance of the liquid, and further including a tubular attachment slidably positioned about said housing and having a first opening coupled to the conduit and a second opening selectively alignable in first and second positions for liquid flow communication respectively with one of said first chamber means outlet and said second chamber means inlet, said slidable attachment defining said first coupling effecting means in said attachment's first position and said second coupling effecting means in said attachment's second position.

12. A system according to claim 11 in which said means for connecting said impellers together comprises means for affixing said driving impeller to said shaft and means for rotatably and reciprocably securing said driven impeller and said shaft together to enable said driving impeller to be removed from said second chamber when said slidable attachment is in its second position.

13. A system according to claim 12 further including a diverter in said first chamber for enhancing liquid flow therein from its inlet to its outlet, said diverter having a recess for receiving said driving impeller when removed from said second chamber.

14. Apparatus for filling a hose with water and simultaneously for expelling air thereform while connected to a pump at its vacuum side in preparation for cleaning debris from a swimming pool without loss of the prime in the pump, comprising:

a housing submergeable in the water and having a pair of chambers respectively having inlets and outlets, with said inlets open to the water and said outlets respectively coupled to the vacuum side of the pump and to the hose;

impellers connected together and respectively placed in said chambers for driving of a first of said impellers by a second thereof when water is drawn into the vacuum side of the pump through said chamber whose outlet is coupled thereto.

15. Apparatus according to claim 14 further including a flow channel in said pump coupled chamber for enhancing movement of the water against turbine vanes on said impeller, and a flow channel in said hose coupled chamber for enhancing laminar flow of water therein.

16. Apparatus according to claim 14 further including a plate in said housing for separation thereof into said chambers, and a shaft extending through and journalled within said plate and having terminations in said chambers for connecting said impellers respectively to said shaft terminations.

17. Apparatus according to claim 16 further including a conduit slidably secured to said housing and having a first opening coupled to said hose and a second opening selectively alignable in first and second positions respectively with said outlet of said hose coupled chamber and said inlet of said pump coupled chamber, said conduit in its first position enabling the water to be drawn by the pump through said pump coupled chamber and to drive said driving impeller and, in turn, said driven impeller for pumping the water through and into said hose coupled chamber and through the hose to expel any air therein, and said conduit in its second position enabling the water to be drawn by the pump through said hose and said pump coupled chamber.

18. Apparatus according to claim 17 in which said plate includes a recess communicating with said pump coupled chamber, and said shaft includes a rotatable and reciprocable connection with said impeller in said hose coupled chamber and solely a rotatable connection with said impeller in said pump coupled chamber to enable said latter impeller to be received in the plate recess when said conduit is in its second position.

19. A claim for purging a gas from a conduit through which a liquid is to be conveyed to and from a source of the liquid by a unidirectional source of negative and positive liquid pressures, the pressure source having an inlet for the negative pressure and an outlet for the positive pressure, without causing the pressure source to lose its prime, comprising the sequential steps of:

operating the unidirectional pressure source for enabling flow of the liquid only from the inlet to the outlet;

coupling both the conduit and the inlet to the liquid source for creating a positive pressure of the liquid in the conduit by the pressure source to flow the liquid in a forward direction away from the pressure source and thus to expel the gas from the conduit; and thereafter coupling the conduit directly to the inlet for creating a negative pressure of the liquid in the conduit by the pressure source to reverse the direction of the liquid flow back towards the pressure source.

20. A method for purging a gas from a conduit through which a liquid is to be conveyed to and from a source of the liquid by a unidirectional source of negative and positive liquid pressures, the pressure source having an inlet for the negative pressure and an outlet for the positive pressure, without causing the pressure source to lose its prime, comprising the sequential steps of:

coupling a first impeller to the pressure source to draw some of the liquid into the pressure source;

coupling a second impeller to the conduit;

coupling the first and second impellers together on a common shaft so that the first impeller causes the second impeller to pump some of the liquid through the conduit in the forward direction;

said above three coupling steps thereby creating a positive pressure of the liquid in the conduit by the pressure source to flow the liquid in a forward direction away from the pressure source and thus to expel the gas from the conduit; and thereafter coupling the conduit directly to the inlet for creating a negative pressure of the liquid in the conduit by the pressure source to reverse the direction of the liquid flow back towards the pressure source.

21. A method according to claim 20 in which said coupling step for creating the negative liquid pressure in the conduit comprises the steps of decoupling the first and second impellers respectively from the pressure source and the conduit, and coupling the conduit to the pressure source.

* * * * *